US010780460B2

(12) United States Patent
Adler et al.

(10) Patent No.: US 10,780,460 B2
(45) Date of Patent: Sep. 22, 2020

(54) HEAT EXCHANGER

(71) Applicant: Linde Aktiengesellschaft, Munich (DE)

(72) Inventors: Robert Adler, Gerasdorf (AT); Ekkehardt Klein, Katzelsdorf (AT); Christoph Nagl, Alland (AT); Andreas Pollak, Forchtenstein (AT)

(73) Assignee: LINDE AKTIENGESELLSCHAFT, Munich (DE)

( * ) Notice: Subject to any disclaimer, the term of this patent is extended or adjusted under 35 U.S.C. 154(b) by 322 days.

(21) Appl. No.: 15/750,591

(22) PCT Filed: Aug. 2, 2016

(86) PCT No.: PCT/EP2016/001328

§ 371 (c)(1),
(2) Date: Feb. 6, 2018

(87) PCT Pub. No.: WO2017/025173

PCT Pub. Date: Feb. 16, 2017

(65) Prior Publication Data

US 2019/0009306 A1 Jan. 10, 2019

(30) Foreign Application Priority Data

Aug. 11, 2015 (DE) ..... 10 2015 010 455

(51) Int. Cl.

| | |
|---|---|
| ***B08B 1/00*** | (2006.01) |
| ***B08B 9/043*** | (2006.01) |
| ***F28F 1/40*** | (2006.01) |
| ***F28G 1/08*** | (2006.01) |
| ***F28G 1/14*** | (2006.01) |

(Continued)

(52) U.S. Cl.

CPC ..... *B08B 1/008* (2013.01); *B08B 9/0436* (2013.01); *F28D 7/106* (2013.01); *F28F 1/40* (2013.01); *F28G 1/08* (2013.01); *F28G 1/14* (2013.01); *F28G 15/08* (2013.01)

(58) Field of Classification Search

None

See application file for complete search history.

(56) References Cited

U.S. PATENT DOCUMENTS

| | | | | |
|---|---|---|---|---|
| 3,585,808 | A * | 6/1971 | Huffman | B01D 5/0036 62/93 |
| 2012/0174691 | A1* | 7/2012 | Yamada | F16H 25/2261 74/89.23 |
| 2016/0018170 | A1* | 1/2016 | Kamino | F28F 1/08 165/94 |

FOREIGN PATENT DOCUMENTS

| | | | | |
|---|---|---|---|---|
| CN | 104 075 615 | A | 10/2014 | |
| DE | 3539884 | A1 * | 5/1987 | B66D 1/38 |

(Continued)

OTHER PUBLICATIONS

English Translation of DE 3539884 A1.*

International Search Report for PCT/EP2016/001328, dated Oct. 7, 2016, Authorized Officer: Andreas Merkt, 3 pages.

*Primary Examiner* — Nicole Blan

(74) *Attorney, Agent, or Firm* — Millen White Zelano & Branigan, PC; Brion P. Heaney

(57) ABSTRACT

A heat exchanger is disclosed having a first cylindrical tube and a lead screw which extends coaxially inside the first cylindrical tube; the inner surface of the first cylindrical tube has guiding grooves, and a cleaning element is secured to the lead screw in such a way that a rotating movement of the lead screw moves the cleaning element in the axial direction along the guiding grooves.

19 Claims, 4 Drawing Sheets

(51) Int. Cl.
*F28D 7/10* (2006.01)
*F28G 15/08* (2006.01)

(56) References Cited

FOREIGN PATENT DOCUMENTS

| | | | |
|---|---|---|---|
| DE | 297 24 316 | U1 | 11/2000 |
| ES | 2 387 169 | A1 | 9/2012 |
| GB | 375 132 | A | 6/1932 |
| GB | 714 926 | A | 9/1954 |
| WO | WO 2008/110834 | A1 | 9/2008 |

* cited by examiner

HEAT EXCHANGER

CROSS-REFERENCE TO RELATED APPLICATIONS

This application claims priority under 35 USC § 119 to International Patent Application No. PCT/EP2016/001328, filed on Aug. 2, 2016, which claims priority from German Patent Application DE 10 2015 010 455.1, filed on Aug. 11, 2015.

BACKGROUND OF THE INVENTION

The present invention relates to a heat exchanger, in particular for natural gas, as a working medium for drying and cleaning the natural gas.

Heat exchangers for heating or cooling a working medium are commonly known from prior art. Without loss of generality, the working medium natural gas will be examined in greater detail below. Natural gas from ground reservoirs often has an especially high percentage of undesired accompanying substances and an especially high water content. It is desirable to remove the accompanying substances and water content from the natural gas before using it for other purposes. One option for doing so is to cool the natural gas in one or more steps to suitably low temperatures. In particular, it may here make sense to liquefy the natural gas.

As the natural gas is cooled, the mentioned accompanying substances in the heat exchangers most often produce deposits on the heat transfer surfaces, wherein the progression of such deposits over time depends on the operating conditions and respective natural gas composition. Therefore, the heat transfer surfaces must be cleaned in certain intervals. For the reasons mentioned, however, it is difficult to indicate generally valid cleaning intervals for the respective heat exchangers.

For example, known gas dryer systems operate with fills comprised of porous materials, such as silica gel. Another method uses triethylene glycol for dehumidifying the working as, wherein the process most often requires multiple stages so that the desired purity can be reached. Humid gases cause hydrate formation and corrosion. Therefore, limits are placed on water content in the gas transport networks.

Compressor stations and downstream elements, such as pipelines, valves, etc., are basically designed for operating with dry working gas, so that water should also be removed from the working medium along with the accompanying substances. For example, the gas drying process can involve mechanical steps (mechanical separation of free water) and thermodynamic steps (separation through pressure reduction), and finally the step of absorption, e.g. via hygroscopic substances such as the mentioned triethylene glycol. The triethylene glycol can be sprayed into the gas flow, and absorbs the remaining water.

Condensing and freezing accompanying substances like water, CO2 and hydrocarbon compounds are deposited onto the heat transfer surfaces, and thereby reduce the heat transfer. Even at operating temperatures above the freezing point of water, methane hydrate forms on the heat transfer surfaces.

As a matter of principle, the porous fills at dryer plants according to prior art require a very large volume. In addition, the fills only absorb the liquid portion, primarily the water portion, from the working gas. While regenerating the fill, for example by having a dry, unsaturated inert gas flow through and/or heating and/or setting the fill, a larger portion of working gas is discharged unused. When replacing the fill in known dryers according to prior art, the container has to be opened so that the fill can be completely replaced. This is cost and labor intensive, and results in an interruption of the production cycle.

The mentioned processes for drying and cleaning gases as the working medium prove to be expensive. It is desirable to reduce the number of procedural steps, without having to accept the disadvantages mentioned above.

SUMMARY OF THE INVENTION

The invention proposes a heat exchanger with a first cylindrical tube and a threaded spindle that runs coaxially in the first cylindrical tube, wherein the inner surface of the first cylindrical tube has guiding grooves, and wherein a cleaning element is secured to the threaded spindle in such a way that rotating the threaded spindle moves the cleaning element in an axial direction along the guiding grooves. This cleaning element serves to clean deposits on the heat transfer surfaces between the inner surface of the first cylindrical tube and the threaded spindle. This cleaning element is either secured directly on the threaded spindle in the form of a tappet, or fastened to such a tappet, which is itself secured directly to the threaded spindle. As explained at the outset, a working medium that flows in a gap between the first cylindrical tube and the threaded spindle for purposes of heat transfer will leave behind deposits on the heat transfer surfaces, in particular in the cooling process. If natural gas is the working medium, these deposits in particular consist of accompanying substances and water. The mentioned deposits can be removed from the cleaning element and/or transported away or entrained. Therefore, the threaded spindle is activated for cleaning, which moves the cleaning element in an axial direction inside of the first cylindrical tube, allowing it to remove deposits from the heat transferring surfaces. In particular, such deposits arise on the threaded spindle, as well as on the axially running guiding grooves of the heat exchanger. The cleaning element cleans these surfaces. The cleaning element can preferably consist of steels, especially Q&T steels and alloys of nonferrous metals, along with cryogenic nickel alloys (such as Inconel), as well as of cast materials.

During normal operation of the heat exchanger, the cleaning element is in a resting position, in which it influences the heat exchange between the working medium and coolant as little as possible, or even not at all. Of course, a thermal medium can also be used instead of a coolant if the working medium is to be heated. For example, cleaning takes place according to empirically determined period durations or once an externally measured maximum permissible differential pressure has been reached, which makes it possible to infer a reduction in the free flow area for the working medium owing to deposits.

The heat exchanger with cleaning element according to the invention permits an effective cleaning of the heat transfer surfaces without having to be manually opened. The described cleaning process is easy to execute. To this end, all that need be done is to turn the threaded spindle to move the cleaning element in an axial direction. Additional procedural steps are not required. In particular, it is advantageous that the cleaning element entrain or transport away existing deposits. As a result, the cleaning element can be prevented from changing, and hence wearing out or ageing.

Without loss of generality, the coolant used for heat exchange flows around an outer surface of the first cylindrical tube. To this end, it is advantageous for the heat exchanger to have a second cylindrical tube arranged coaxially to the first cylindrical tube. In this conjunction, it further makes sense that an inlet and outlet opening be present for the coolant, so as to admit and discharge coolant into or from a gap between the second and first cylindrical tube. In like manner, it makes sense that an inlet and outlet opening be present for a working medium, so as to admit and discharge the working medium into or from a gap between the first cylindrical tube and threaded spindle.

It is advantageous that the cleaning element be designed as an essentially hollow cylindrical cleaning element, wherein the inner surface of the cleaning element has a female thread corresponding to the thread of the threaded spindle, and wherein the outer surface of the cleaning element has outer grooves corresponding to the guiding grooves of the inner surface of the first cylindrical tube. In this way, the cleaning element can be easily (without separate tappets) secured to the threaded spindle, and remove existing deposits on heat transferring inner surfaces in the gap between the inner surface of the first cylindrical tube and threaded spindle as thoroughly as possible.

It makes sense that the cleaning element have recesses in the otherwise essentially cylindrical circumference of the cleaning element, wherein these recesses extend parallel to the axial direction. In particular, these recesses are equidistantly arranged in the cleaning element in the circumferential direction. The recesses or milled grooves generate "teeth" or "claws" in the cleaning element, which in particular help prevent the cleaning elements from becoming jammed or blocked in the cleaning process. Deposits detached from the threaded spindle can get into the mentioned recesses or milled grooves, and from there drop down (in the direction of movement of the cleaning element) during the vertical operation of the heat exchanger at least in the cleaning phase. This makes it possible to effectively prevent the cleaning elements from getting blocked by accumulating deposits.

It further makes sense that the female thread of the cleaning element have a diameter that increases in the axial direction. As a result of this configuration, the threaded grooves are not cleaned as abruptly as for a cleaning element that rests on the threaded grooves over its entire expansion in the axial direction. This prevents the cleaning element from getting wedged. In conjunction with the embodiment mentioned above, in which the cleaning element has axial recesses, the resultantly generated individual "claws" or "teeth" become more elastic, and press against the outer wall or threaded grooves more effectively. Another advantage involves the free space formed as a result, which is comparable to a chip channel of a machining method.

It is advantageous that the outer surface of the first cylindrical tube have a coil that runs spirally in an axial direction. This coil is part of the outer surface of the first cylindrical tube, and is applied to this outer surface or generated by milling. The coolant can then flow spirally in an axial direction in the gap between these coils. This first cylindrical tube with this coil can thus also be referred to as a cooling coil.

It is advantageous that a deposit store for deposits/contaminants washed away by the cleaning element be connected with the gap between the threaded spindle and inner surface of the first cylindrical tube/cooling coil, in particular in a thermally decoupled manner. In this advantageous embodiment, the cleaning element transports contaminants into the deposit store, which is thermally decoupled in particular from the mentioned heat transferring surfaces, i.e., the gap between the threaded spindle and inner surface of the first cylindrical tube. This thermal decoupling permits a thermal treatment of the accompanying substances that accumulated in the deposit store or other deposits without influencing the further operation of the heat exchanger. To this end, a heating element is advantageously present in or on the heat exchanger, and arranged in such a way that accompanying substances/contaminants present in the deposit store can be heated. While the working medium is cooled, contaminants present in the working medium, such as accompanying substances and water, condense out. The cleaning element can transport the condensed contaminants into the deposit store, which then can also be referred to as a condensate reservoir, for example. The accumulated condensate can subsequently be heated by means of the mentioned heating element. The heated condensate that was made to melt can be discharged through a condensate drain by opening a downstream valve. In this way, the deposit store can on its part be freed of present contaminants at prescribed times.

During the cleaning process, it makes sense to acquire knowledge about the position of the cleaning element. For this purpose, a position measuring device is advantageously present, and arranged in such a way that the position of the cleaning element in the axial direction can be measured. Such a position measurement makes it possible or easier to reverse the rotational direction of the threaded spindle at a specific, prescribed position, so that the cleaning element moves back in the opposite direction. The position measuring device can also be used to easily detect when a predetermined resting position has been reached.

In order to drive the threaded spindle, it is advantageous to use a drive motor, wherein a particle barrier is present between the drive motor and the gap between the threaded spindle and inner surface of the first cylindrical tube, i.e., between the drive motor and the heat conducting surfaces of the heat exchanger. Such a particle barrier prevents foreign substances from penetrating into the space in which the working medium flows to the heat exchanger, and conversely serves to protect the drive motor or its bearing against particles.

In summation, in the following preferred structural design of a heat exchanger according to the invention, the individual features do not necessarily have to be realized in the combination specified here. The interior threaded spindle is enveloped by a first cylindrical tube or the cooling coil. The latter is for its part enveloped by a second cylindrical tube or an outer cylindrical tube. The gap between the threaded spindle and cooling coil comprises the work area for the working medium, which is supplied to this space via an inlet opening, and removed from this space after the heat exchange via an outlet opening. It can make sense to reverse the direction of flow, wherein the mentioned inlet opening is to this end used as the outlet opening, and the mentioned outlet opening as the inlet opening. However, it is advantageous in such a case to provide another outlet opening on the side of the mentioned inlet opening and another inlet opening on the side of the mentioned outlet opening for the working medium on the heat exchanger. In this case, two opposing ports are available for the working medium to respectively enter and exit, which in the following are also referred to as "two-sided" inlet opening or "two-sided" outlet opening. A coolant is added to the gap between the cooling coil and outer cylindrical tube through a coolant inlet opening, and flows through this gap to a coolant outlet opening, so as to exit this gap once again. That which was stated for the inlet and outlet opening for the working medium applies analogously for the coolant inlet and outlet opening, i.e., it is advantageous to provide a two-sided coolant inlet and outlet. It makes sense for the coolant to flow counter-currently to the flow of the working medium. It may also make sense for the coolant to flow co-currently to the flow of the working medium.

Located on one side of the heat exchanger is the drive motor, which imparts rotation to the threaded spindle. The threaded spindle is mounted in a bearing. Located on this bearing is a position measuring device, which can use the number of revolutions of the drive motor at a known pitch for the thread of the threaded spindle to deliver information about the position of the cleaning element moved by the threaded spindle. When in the resting position, the cleaning element, which can also be referred to as a reamer, is preferably located on the same side as the drive motor, and is separated from the latter by a particle barrier. For example, such a particle barrier can be fabricated out of PTFE, and is then so soft even at low temperatures that the particles can accumulate therein. The radial distance to the shaft is as small as possible, ideally a few tenths of a mm, preferably less than 0.4 mm, further preferably less than 0.3 mm, further preferably roughly equal to 0.2 mm.

Located on the other side of the heat exchanger at the end of the work area through which the working medium flows is a deposit store or condensate reservoir, which in particular is thermally decoupled from this work area. This is followed by a heating element, which is thermally coupled with the condensate reservoir so as to heat the latter. The condensate reservoir is connected with the environment of the heat exchanger via a condensate drain, so that the contents of the condensate reservoir can be emptied. Also located at this end of the heat exchanger is a plain bearing bushing for the threaded spindle.

How such an advantageous heat exchanger according to the invention operates will be explained in more detail below. Depending on the direction of flow, moist, dirty working medium flows through the respective working medium inlet opening into the space between the threaded spindle and cooling coil, and flows in the direction of the opposing outlet opening. The working medium here flows in the guiding grooves of the inner surface cooling coil along the rotational axis of the threaded spindle. Heat is removed from the cooling coil by a coolant, wherein this coolant preferably flows counter-currently to the working medium in the space formed between the cooling coil and outer cylindrical tube. This cooling causes the temperature of the working medium to drop, and the accompanying substances or contaminants fall onto the heat transfer surfaces in accordance with their liquefaction or solidification temperatures. These contaminants reduce the heat transfer capacity between the working medium and cooling coil.

In order to clean the heat transfer surfaces, the threaded spindle is made to rotate by the drive motor. The housing of the drive motor is here preferably connected with the gap through which the working medium flows, and thus exposed to the operating pressure. The thread of the threaded spindle is here preferably designed as a right-hand thread with a trapezoidal profile, wherein left-hand threads and other flank shapes are in principle potentially conceivable and advantageous. Let reference also be made to the passages below in this regard. The cleaning element or reamer engages into the thread of the threaded spindle on the one hand, and into the guiding or profile grooves of the cooling coil on the other, which imparts a translational movement to the cleaning element.

As a result of the defined thread pitch of the threaded spindle, the number of revolutions of the drive motor measured by the positioning means can be used to acquire the position of the cleaning element. The cleaning element here slides up to the thermally decoupled condensate reservoir or deposit store at the end of the work area. The cleaning element thus pushes the existing, entrained deposits into the condensate reservoir. As soon as the corresponding position has been reached, the rotational direction of the drive motor is reversed, and the cleaning element wanders back into its resting position next to the particle barrier. The accumulated condensate can be heated by the heating element, and made to melt or evaporate depending on the aggregate state, and then discharged by opening a downstream valve through the preferably two-sided condensate drain.

In particular, it is advantageous to combine several heat exchangers connected in series into one heat exchanger system. This type of incremental structure makes it possible to "freeze out" contaminants when the individual stages are each operated at lower temperatures.

As an alternative to the mentioned threaded spindle with trapezoidal profile, a threaded spindle with cross thread can advantageously be used. Such threaded spindles are known in the art, and are referred to as cross threaded spindles. Threaded spindles with trapezoidal profiles can always only reproduce an allocated direction of movement based on their rotational direction, which as a consequence thereof also reverses given a reversal of the rotational direction. Reversing the rotational direction requires a switching element in the electrical power supply of the drive motor or a change speed gearbox. In order to prevent defined end positions from running over elements sliding on threaded spindles, such as the cleaning element, they are frequently equipped with a position stop. As an alternative, the position of the sliding element is acquired with a position detection means.

The use of cross threaded spindles overcomes these disadvantages. A cross thread is structured in such a way that one spindle has formed on it both a left-hand thread and a right-hand thread, each with preferably the same pitch, wherein their respective end positions have a reversal point in which at least one sliding block that slides in the threaded groove is moved from a first direction of movement into a second direction of movement. The rotational direction of the shaft of the threaded spindle thus always remains the same. As a consequence, using a cross threaded spindle also eliminates the need for the position measuring device described above for the position of the cleaning element. To this end, the upper end position, i.e., the resting position of the cleaning element, must be determined using an alternative process. For example, a torque measurement is possible for this purpose, which registers marked changes in the torque in the two end positions of the cleaning element. Additionally or alternatively, the end positions or at least the upper end position of the resting position can be determined by means of initiators, i.e., end position switches.

In a simplified embodiment, the heat exchanger according to the invention thus has a cross threaded spindle with at least one sliding block, which slides into the threads, and a reamer or cleaning element connected with the sliding block, for example by means of a bolt.

The advantages to using the cross threaded spindle lie in an automatic reversal of the direction of movement without changing the rotational direction of the shaft, so that a braking and restarting of the electric is rendered obsolete, which in turn results in a process that economizes on energy. In addition, as already explained, no electrical device must be provided for reversing the rotational direction, or a corresponding program part in the controller is eliminated. As a whole, the process of cleaning the heat exchanger is shortened by the omitted reversal of direction. The end positions of the cleaning element are automatically defined by the reversal edge of the cross thread, and can thus not be run over. The position measuring device described above can ultimately be eliminated.

The invention further relates to an application of the heat exchanger according to the invention for liquefying a gas. A second cylindrical tube is here arranged coaxially to the first cylindrical tube of the heat exchanger, wherein a coolant flows between the first and second cylindrical tube. In addition, a working medium flows between a first cylindrical tube and threaded spindle, which contains the gas to be liquefied. In the example for natural gas described above, the gas to be liquefied can be nitrogen, for example. The cooling medium flows at a lower temperature than the working medium, wherein the pressure and temperature of the cooling medium along with the pressure of the working medium are adjusted in such a way that the gas to be liquefied is liquefied in the working medium through heat exchange with the cooling medium. In the example for natural gas mentioned above, for example, liquefied nitrogen as the cooling medium can be used at a pressure of 1 bar and a temperature of −196° C. In particular after correspondingly precooled by upstream heat exchangers, the working medium (natural gas) is introduced at a pressure of 10 bar, for example. The nitrogen contained in the natural gas can cool down to a temperature of −170° C. and below through heat exchange with the cooling medium, so that it liquefies at a pressure of 10 bar.

The specified method can be analogously used for liquefying helium, oxygen and/or hydrogen as one or more constituents in a working medium. Concrete examples for liquefying helium, hydrogen and oxygen are indicated below:

Liquefaction of different gases, for example for purposes of precipitation from gas mixtures Liquefaction of $O_2$:

Cooling medium, preferably liquid nitrogen, between 1 and 15 bar;

Temperature range of cooling medium −163° C. @ 15 bar to −196° C. @ 1 bar;

Pressure of the $O_2$ to be liquefied 1 bar-50 bar;

First liquefaction temperature @ 1 bar −183° C.;

Second liquefaction temperature @ 50 bar −119° C.;

The pressure of the cooling medium is selected so that the temperature of the cooling medium is always lower than that of the working medium.

Liquefaction of $H_2$:

Cooling medium, preferably liquid helium, between 1 and 2.2 bar;

Temperature range of cooling medium −267° C. @ 2.2 bar to −268° C. @ 1 bar;

The pressure of the cooling medium is respectively selected so that the temperature of the cooling medium is always lower than that of the working medium.

Alternative cooling medium liquid hydrogen between 1 and 13 bar;

Temperature range of cooling medium −240° C. @ 13 bar to −253° C. @ 1 bar. In a special case where the same medium as the medium to be liquefied is used as the cooling medium, the pressure in the cooling medium must be lower than the pressure of the working medium, so that the coolant temperature is lower owing to the lower equilibrium point.

Pressure of liquefied $H_2$ 1 bar-13 bar,

First liquefaction temperature @ 1 bar −253° C.;

Second liquefaction temperature @ 13 bar −240° C.;

Liquefaction of He:

Cooling medium, preferably liquid helium, between 1 and 2.2 bar;

Temperature range of cooling medium −267° C. @ 2.2 bar to −268° C. @ 1 bar;

In a special case where the same medium as the medium to be liquefied is used as the cooling medium, the pressure in the cooling medium must be lower than the pressure of the working medium, so that the coolant temperature is lower owing to the lower equilibrium point.

Pressure of liquefied He 1 bar-2.2 bar,

First liquefaction temperature @ 1 bar −268° C.;

Second liquefaction temperature @ 2.2 bar −267° C.;

It goes without saying that the features mentioned above and yet to be described below can be used not just in the respectively indicated combination, but also in other combinations or taken separately, without departing from the framework of the present invention.

The invention is schematically illustrated in the drawing based on an exemplary embodiment, and will be described below with reference to the drawing.

DETAILED DESCRIPTION OF THE INVENTION

Figure 1:
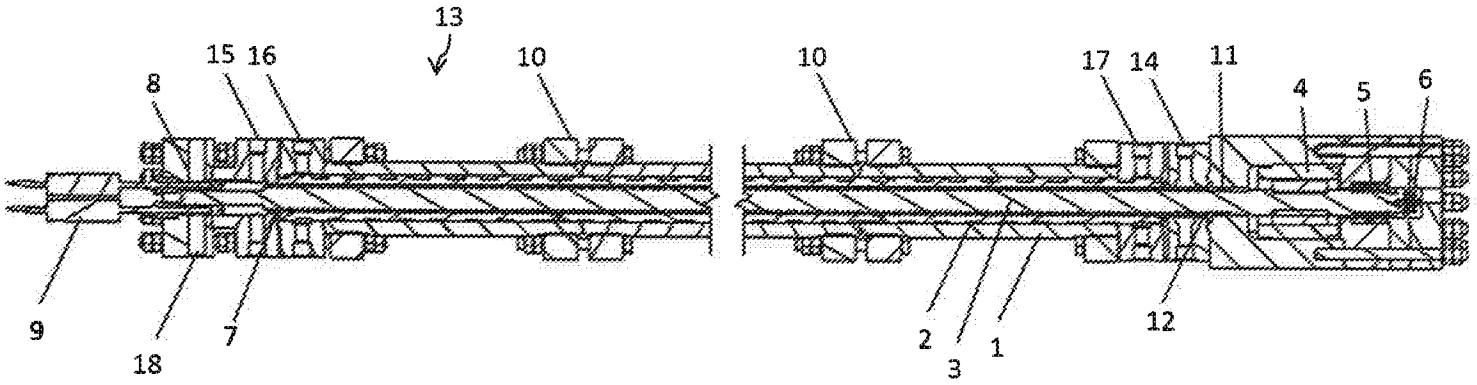
FIG. 1 schematically shows a longitudinal section of an advantageous embodiment of a heat exchanger according to the invention.
Figure 2:
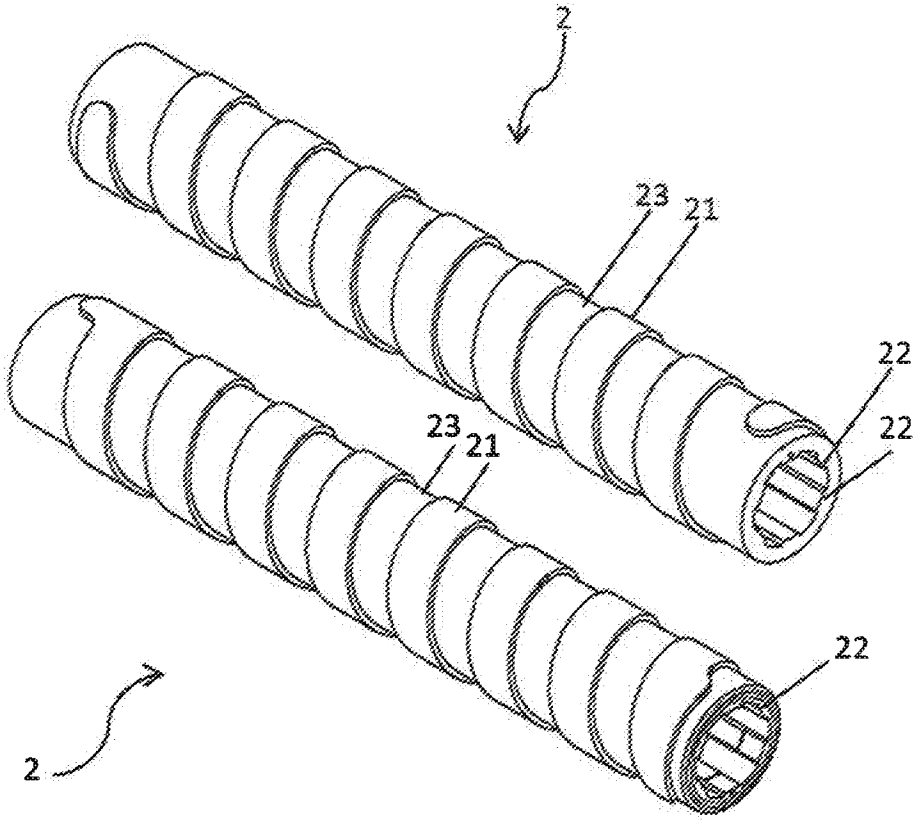
FIG. 2 shows a cooling coil as the first cylindrical tube of the heat exchanger depicted on FIG. 1.

FIG. 1 presents a schematic, longitudinal section through an embodiment of a heat exchanger 13 of the kind that can be used in particular for cooling natural gas. In this simple configuration, the heat exchanger 13 has an outer cylindrical tube 1 that envelops a cooling coil 2. This cooling coil 2 is for its part designed as a cylindrical tube, and has at least one, preferably spiral channel 23 on its outer surface that serves to guide a coolant. As illustrated on FIG. 2, this channel 23 is generated by a corresponding coil 21 on the outer surface of the cooling coil 2. The inner surface of the hollow cylindrical cooling coil has guiding or profile grooves 22. This at least one guiding groove 22 serves to guide a cleaning element or reamer 12.

Located inside of the cooling coil 2 coaxially thereto is a threaded spindle 3. The threaded spindle 3 is driven by a drive motor 4, and mounted in a bearing point preferably designed as an axial/radial mixed bearing 5. At the other end of the threaded spindle 3, the latter is mounted in a bearing point preferably designed as a plain bearing bushing 8. Also present at this end of the heat exchanger 13 is a thermally decoupled condensate reservoir 7, along with a heating element 9 for heating condensate in the condensate reservoir 7.

At the other end of the heat exchanger 13, a particle barrier 11 separates the drive motor 4 from the work area for the working medium. The particle barrier 11 also serves to protect the drive motor 4 and bearing 5 against coarse particles, but does not act as a gas seal.

In the embodiment according to FIG. 1 illustrated here, several outer cylindrical tubes 1 are connected by a clamping device 10. The clamping device 10 is structured in such a way that two union nuts with a female thread are screwed onto the outer cylindrical tube 1, which in turn is provided with a male thread. The union nuts are drawn together by means of screws, and the individual segments are pressed together and sealed by a gasket. Several such outer cylindrical tubes can also be understood and referred to as an "outer cylindrical tube".

A cleaning element or reamer 12 is arranged next to the particle barrier 11 in its resting position. When starting up the drive motor 4, the threaded spindle 3 is made to rotate, so that the reamer 12 is shifted on the threaded spindle along the guiding or profile grooves 22 of the cooling coil 2 in an axial direction. In the present example, a threaded spindle 3 with a trapezoidal profile is used, for example. Reversing the direction of movement of the reamer 12 presupposes a reversal in the rotational direction of the threaded spindle 3. Another type of design for the threaded spindle 3 is described further below in conjunction with FIG. 4.

For example, moist, dirty working medium is guided via a working medium inlet opening 1 into the gap between the threaded spindle 3 and cooling coil 2 during the operation of the heat exchanger 13, and flows in an axial direction to the working medium outlet opening 15 at the end of the heat exchanger 13. The working medium here flows in the profile grooves 22 on the inner surface of the hollow cylindrical cooling coil 2 (see FIG. 2) along the rotational axis of the threaded spindle 3. Coolant is supplied to the space between the cooling coil 2 and outer cylindrical tube 1 via a coolant inlet opening 16, flows to the other end of the heat exchanger 13, and exits the latter through the coolant outlet opening 17. The coolant here flows spirally in an axial direction in the channel 23 formed between the outer cylindrical tube 1 and cooling coil 2. The coolant withdraws heat from the cooling coil 2, so that heat is in turn withdrawn from the working medium.

In a special application, natural gas at a pressure of 4 to at most 220 bar from an underground cavern is heated to a temperature of approx. 20° C. In a first heat exchanger, the working medium is cooled preferably to 1° C. In a second heat exchanger connected in series with the first heat exchanger, the working medium is preferably cooled to −40° C. to −60° C. In a third stage, the working medium is preferably cooled to −80° C. to −150° C., and in a last stage, the working medium is liquefied via a heat exchanger once again connected in series. The temperature of the natural gas is here lowered down to −196° C., wherein the natural gas is supercooled. The first stage here precipitates a majority of the water portion, the next stage predominantly precipitates the higher hydrocarbons, $CO_2$ and other accompanying substances. The reamers 12 present in the respective stages of the heat exchangers 13 make it possible to clean condensed constituents from the respective heat transferring surfaces.

In this concrete interconnection case, the first two heat exchanger stages are cooled by refrigerators, and the other two by liquid nitrogen, cryogenic, liquid CNG or cryogenic, gaseous nitrogen. The maximum operating pressure of the heat exchanger is 300 bar, while the permissible operating temperatures measure 100° C. to −200° C.

The different pressure correlations between the cooling medium, for example nitrogen at a maximum of 10 bar, and the working medium, here CNG with accompanying substances to include nitrogen of 4 to 220 bar, nitrogen at a high pressure (e.g., at 10 bar) can be made to liquefy and precipitate by liquid nitrogen at a low pressure (e.g., at 1 bar), owing to the different, pressure-dependent phase transitions. The heat exchanger 13 proposed here can thus also be used for liquefying nitrogen.

For purposes of cleaning the heat transferring surfaces, for example to remove water or ice in the first stage or higher hydrocarbons, $CO_2$ and other accompanying substances in the second and additional stage, the threaded spindle 3 of one stage is made to rotate by the drive motor 4. As a result, a translational movement is imparted to the reamer 12, which engages into the thread of the threaded spindle 3 on the one hand and into the profile grooves 22 of the cooling coil 2 on the other. On its way toward the condensate reservoir 7, the reamer 12 entrains the mentioned condensed accompanying substances. The latter are pushed into the condensate reservoir 7 once having reached it. Due to the defined thread pitch of the threaded spindle 3, the position measuring device 6 can determine the position of the reamer 12 from the number of measured revolutions of the drive motor 4. As soon as the position of the condensate reservoir 7 has been reached, the rotational direction of the drive motor 4 is reversed, so that the reamer 12 wanders back to its resting position. It makes sense for the resting position to be the upper end position and the position of the condensate reservoir 7 to be the lower end position of the reamer 12 in the vertical position of the heat exchanger.

The accumulated condensate is heated via the heating element 9, and thereby made to melt. The accompanying substances can be discharged through a condensate drain 18 by opening a downstream valve.

For example, the heat exchanging surfaces of the heat exchanger 13 are cleaned after empirically determined period durations or upon reaching an externally measured maximum permissible differential pressure, which makes it possible to infer a reduction in the free flow cross section in the work area caused by deposited accompanying substances. Cleaning yields the highest and most constant possible heat transfer value. The heat exchanger 13 requires a smaller construction volume by comparison to systems in prior art.

The segmented structure of the heat exchanger 13 enables a modular structure. As a consequence, the heat transfer capacity can be varied by enlarging or reducing the heat transfer surfaces.

By using the mentioned position determining device 6, the actual position of the reamer 12 is always monitored. Any seizing can be detected early by measuring slippage.

Let it be noted that the heat exchanger 13 described here can be adapted and used not just for natural gas liquefaction, but also for a plurality of industrial applications with corresponding working media. As a fairly simple replacement part, the reamer 12 can be tailored to the requirements of the respective areas of application, and quickly replaced in the event of damage.

Figure 3:
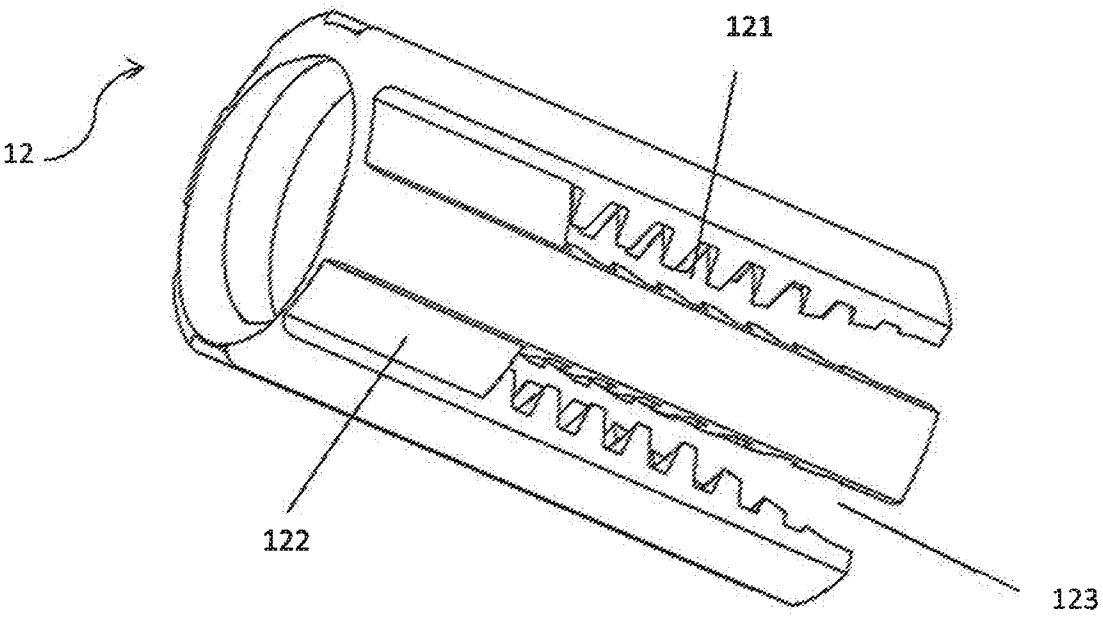
FIG. 3 shows a cleaning element of the kind used in the heat exchanger according to FIG. 1, and FIG. 4 schematically shows the cutout of a threaded spindle with a cross thread.

FIG. 3 shows a reamer 12 or cleaning element 12 of the kind that can be used in the heat exchanger 13. Depicted are the outer grooves 122 of the reamer 12, which correspond to the guiding grooves 22 of the cooling coil 2. The female thread 121 of the reamer 12 corresponds to the thread of the threaded spindle 3. The reamer 12 has recesses or milled grooves 123. The latter provide the reamer 12 with "teeth" or "claws", which prevent deposits from accumulating in the thread and ending up blocking the reamer 12. Specifically, the deposits can enter into the gap through the recesses and milled grooves 123, and with the heat exchanger in a vertical position drop downwardly toward the condensate reservoir 7. Furthermore, the inner diameter of the reamer 12 that enlarges in the direction of cleaning movement enables an easier introduction into the contaminated threaded spindle as the cleaning process begins.

Figure 4:
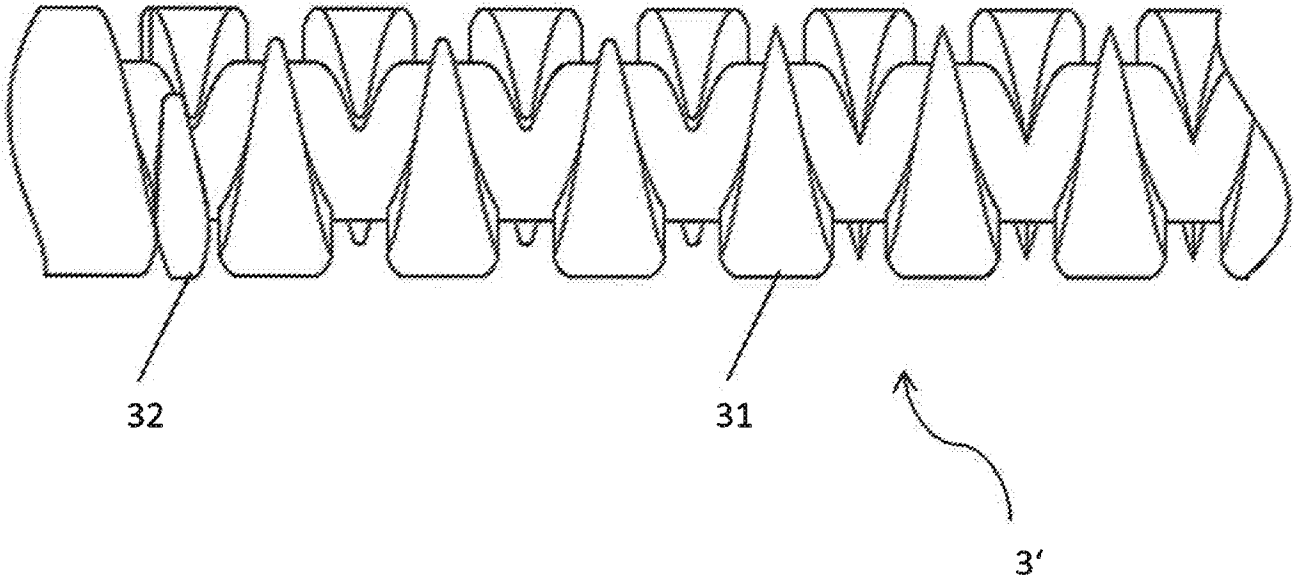

Finally, FIG. 4 shows an alternative configuration of a threaded spindle 3', which involves a cross threaded spindle 3'. The shaft with cross thread is marked 31. The sliding block running therein is marked 32. In this configuration, the reamer 12 is connected with the sliding block 32, and moves in an axial direction as the threaded spindle 3' rotates.

As already explained above, the advantage here is that the sliding block 32 that slides into the threaded groove is moved from a first direction of movement into a second, opposite direction of movement while the threaded spindle 3' is rotated in a single rotational direction, without changing the rotational direction of the shaft 31.

Overlapping the left-hand and right-hand thread results in a typically deltoid-shaped pattern on the shaft 32.

As also described above, the threaded spindle 3' permits an energy-economizing process, since the electric motor does not have to be slowed down and restarted. In addition, the position of the reamer 12 does not have to be measured, thereby eliminating the need for the position measuring device 6. The cleaning process of the heat exchanger 13 is shortened yet again by eliminating the directional reversal.

REFERENCE LIST

1 Outer cylindrical tube, second cylindrical tube
2 Cooling coil, first cylindrical tube
3, 3' Threaded spindle
4 Drive motor
5 Axial/radial bearing
6 Position measuring device
7 Condensate reservoir, deposit store
8 Plain bearing bushing
9 Heating element
10 Clamping device
11 Particle barrier
12 Reamer, cleaning element
13 Heat exchanger
14 Working medium inlet opening
15 Working medium outlet opening
16 Coolant inlet opening
17 Coolant outlet opening
18 Condensate drain
21 Coil
22 Guiding groove, profile groove
23 Channel
121 Female thread of cleaning element
122 Outer groove
123 Recess, milled groove
31 Shaft of threaded spindle 3'
32 Sliding block

What we claim is:

1. A heat exchanger comprising:

a first cylindrical tube and a threaded spindle that runs coaxially in the first cylindrical tube, and a second cylindrical tube arranged coaxially to the first cylindrical tube, wherein the inner surface of the first cylindrical tube has guiding grooves, and wherein a cleaning element is secured to the threaded spindle in such a way that rotating the threaded spindle moves the cleaning element in an axial direction along the guiding grooves.

2. The heat exchanger according to claim 1, wherein the outer surface of the first cylindrical tube has a coil that runs spirally in an axially direction.

3. The heat exchanger according to claim 1, wherein the cleaning element is a hollow cylindrical cleaning element having a cylindrical circumference, wherein the inner surface of the cleaning element has a female thread corresponding to the thread of the threaded spindle, and wherein the outer surface of the cleaning element has outer grooves corresponding to the guiding grooves of the inner surface of the first cylindrical tube.

4. The heat exchanger according to claim 3, in which the cleaning element has recesses in the cylindrical circumference, and said recesses which extend parallel to the axial direction.

5. The heat exchanger according to claim 4, in which the recesses are equidistantly arranged in the cleaning element in the circumferential direction.

6. The heat exchanger according to claim 3, in which the female thread of the cleaning element has a diameter that increases in the axial direction.

7. The heat exchanger according to claim 1, wherein an inlet and outlet opening is present for a coolant, so as to admit and discharge coolant into or from a gap between the second cylindrical tube and the first cylindrical tube.

8. The heat exchanger according to claim 1, wherein an inlet and outlet opening is present for a working medium, so as to admit and discharge the working medium into or from a gap between the first cylindrical tube and the threaded spindle.

9. The heat exchanger according to claim 1, wherein a deposit store for contaminants washed away by the cleaning element is connected with the gap between the threaded spindle and the inner surface of the first cylindrical tube.

10. The heat exchanger according to claim 9, in which a heating element is present and arranged in such a way that contaminants present in the deposit store can be heated.

11. The heat exchanger according to claim 1, in which a position measuring device is present and arranged in such a way that a position of the cleaning element in the axial direction can be measured.

12. The heat exchanger according to claim 1, wherein a drive motor is present for driving the threaded spindle, and wherein a particle barrier is present between the drive motor and the gap between the threaded spindle and the inner surface of the first cylindrical tube.

13. The heat exchanger according to claim 1, wherein the threaded spindle has a trapezoidal profile as the thread profile.

14. The heat exchanger according to claim 1, wherein the threaded spindle has a cross thread as the thread.

15. The heat exchanger according to claim 14, in which a sliding block connected with the cleaning element is slide mounted in the threaded groove of the cross thread of the threaded spindle.

16. The heat exchanger according to claim 1 comprising more than one heat exchanger connected in series.

17. A method for liquefying a gas using a heat exchanger according to claim 1, said method comprising:

flowing a coolant between the first and the second cylindrical tube, flowing a working medium between the first cylindrical tube and the threaded spindle wherein said working medium contains the gas to be liquefied, and flowing the coolant at a lower temperature than that of the working medium, and wherein the pressure and temperature of the coolant along with the pressure of the working medium are adjusted in such a way that the gas to be liquefied is liquefied in the working medium through heat exchange with the cooling medium.

18. The method according to claim 17, wherein the coolant is the same medium as the gas to be liquefied, and wherein the pressure selected for the coolant is lower than that of the working medium.

19. The method according to claim 17, wherein the gas to be liquefied is nitrogen, helium, oxygen or hydrogen.

* * * * *